US005332392A

United States Patent [19]

Bierbaum et al.

[11] Patent Number: 5,332,392

[45] Date of Patent: Jul. 26, 1994

[54] DENTAL INSTRUMENT DEPOSIT TABLE

[75] Inventors: Thomas Bierbaum, Bensheim; Heinz Schulz, Bensheim-Zell; Klaus Stoeckl, Bensheim, all of Fed. Rep. of Germany

[73] Assignee: Siemens Aktiengesellschaft, Munich, Fed. Rep. of Germany

[21] Appl. No.: 932,256

[22] Filed: Aug. 19, 1992

[30] Foreign Application Priority Data

Aug. 29, 1991 [EP] European Pat. Off. ..... 91114558.9

[51] Int. Cl.[5] ..... A61G 15/00

[52] U.S. Cl. ..... 433/77; 433/79

[58] Field of Search ..... 433/77, 79, 49

[56] References Cited

U.S. PATENT DOCUMENTS

| | | | |
|---|---|---|---|
| 3,271,860 | 9/1966 | Burton . | |
| 3,774,773 | 11/1973 | Brent . | |
| 4,179,813 | 12/1979 | Runnells et al. | 433/79 |
| 4,206,546 | 6/1980 | Runnells et al. | 433/79 |
| 4,275,940 | 6/1981 | Draper | 433/79 X |
| 4,386,910 | 6/1983 | Cattani | 433/92 |
| 4,571,182 | 2/1986 | Beier et al. | 433/79 |
| 4,976,616 | 12/1990 | Eisner et al. | 433/77 |
| 5,127,830 | 6/1992 | Sheridan et al. | 433/77 |
| 5,161,970 | 11/1992 | Baskas | 433/77 |

FOREIGN PATENT DOCUMENTS

| | | | |
|---|---|---|---|
| 1953694 | 4/1971 | Fed. Rep. of Germany . | |
| 2657675 | 6/1978 | Fed. Rep. of Germany . | |
| 2539614 | 7/1984 | France | 433/79 |

*Primary Examiner*—Gene Mancene
*Assistant Examiner*—Cindy A. Cherichetti
*Attorney, Agent, or Firm*—Hill, Steadman & Simpson

[57] ABSTRACT

A dental instrument deposit table includes a base member, which has an arrangement for mounting it, and a cover unit which unit includes a deposit surface for receiving the instruments and holders for receiving handpieces, such as handpieces having hoses and handpieces having cables secured thereto. The cover unit is removably mounted on the base member, which, preferably, has a catch member for grasping a rear edge of the cover member and a catch hook for engaging a front lower edge of the cover member to hold the cover member on the base member. Handles are preferably provided on the cover member, which handles can be used for positioning the instrument deposit table.

12 Claims, 3 Drawing Sheets

DENTAL INSTRUMENT DEPOSIT TABLE

BACKGROUND OF THE INVENTION

The present invention is directed to a dental instrument deposit table that, in addition to containing a deposit surface for the instruments, contains holder means for cable-bound and hose-bound handpieces, as well as manipulation means with which a positional change of the instrument deposit table can be produced.

Dental instrument deposit tables have mainly three functional areas that are practically constantly exposed to contamination with germs and must, therefore, be considered especially critical from a hygienic viewpoint. A first area is the placement or, respectively, deposit surface for the instruments, which may be hand instruments, materials, instrument arrays and trays. A second area is holder means for the hose-bound and cable-bound handpieces that can be contaminated with germs when using the instruments. A third functional area is the manipulation means with which the change in position of the instrument deposit table can be produced. Given mechanical displaceability of the instrument deposit table, these manipulation means are usually one or more grips or, respectively, grip-like structures that are provided at a suitable location on the instrument deposit table.

In order to satisfy the demands made of hygiene, a change has already been made for arranging the grips in a removable fashion or to provide them with a protective coating fashioned as a throw-away article. Such an arrangement is disclosed in U.S. Pat. No. 4,976,616. Apart from the fact that only a part of the hygiene problem can be solved with this proposal, coverings, such as other materials, are employable only once, for example paper napkins that can be placed onto the placement surface for the array of instruments, and this material represents a material that is additionally required, which allows the quantity of waste that has already been recently increasing to increase to even a greater degree.

U.S. Pat. No. 3,271,860 also discloses that a plurality of handpieces together with their supply hoses can be arranged next to one another and above one another in compartments sub-divided by partitions in a container that is fashioned box-like and can be closed on all sides. The container can be removed from the cabinet unit and can be put into a sterilizer for the purpose of sterilizing both the handpieces and their supply hoses. When removing the container, the supply hoses of the handpieces are separated from their leads and the line connection must be restored upon reintroduction or return of the container. A sterilization of the entire container including the handpieces and their supply hoses contained therein is relatively complicated and also is involved in terms of manipulation, particularly in view of the uncoupling and recoupling of the supply hoses required with each sterilization.

SUMMARY OF THE INVENTION

An object of the present invention is to provide a dental instrument deposit table that, in addition to containing a deposit surface for the instruments, contains holder means for hose-bound and cable-bound handpieces, as well as manipulation means with which a change in the position of the instrument deposit table can be produced, which table achieves an improvement in comparison thereto and to specify a solution that is relatively simple to handle for the user. This solution enables the instrument deposit table to be kept clean for the purpose of the required hygiene, such as cleaning and/or disinfecting and/or sterilization, without the additional materials that must be disposed of as waste being required for this purpose.

The dental instrument deposit table of the present invention has a base member which is mounted on a mounting arrangement and includes a structural unit which includes at least the deposit surface and the holder means for the handpieces and, preferably, also manipulation means for changing a position of the instrument deposit table, which is detachably mounted on the base member and is composed of a material that is at least resistant to cleaning agents and/or disinfectants.

In that at least two and preferably three sections of the critical function areas of the instrument deposit table are combined to form the structural unit in the invention, it is held in an easily removable fashion on the instrument deposit table, and it is relatively easy for the user to keep these regions faultless hygienically clean within the framework of the possibilities available to him. After removal from the remaining parts of the instrument deposit table, for example, the entire structural unit can be completely cleaned, disinfected and potentially sterilized in a washing and disinfecting device.

Other advantages and features of the invention will be readily apparent from the following description of the preferred embodiments, the drawings and claims.

DESCRIPTION OF THE PREFERRED EMBODIMENTS

Figure 1:
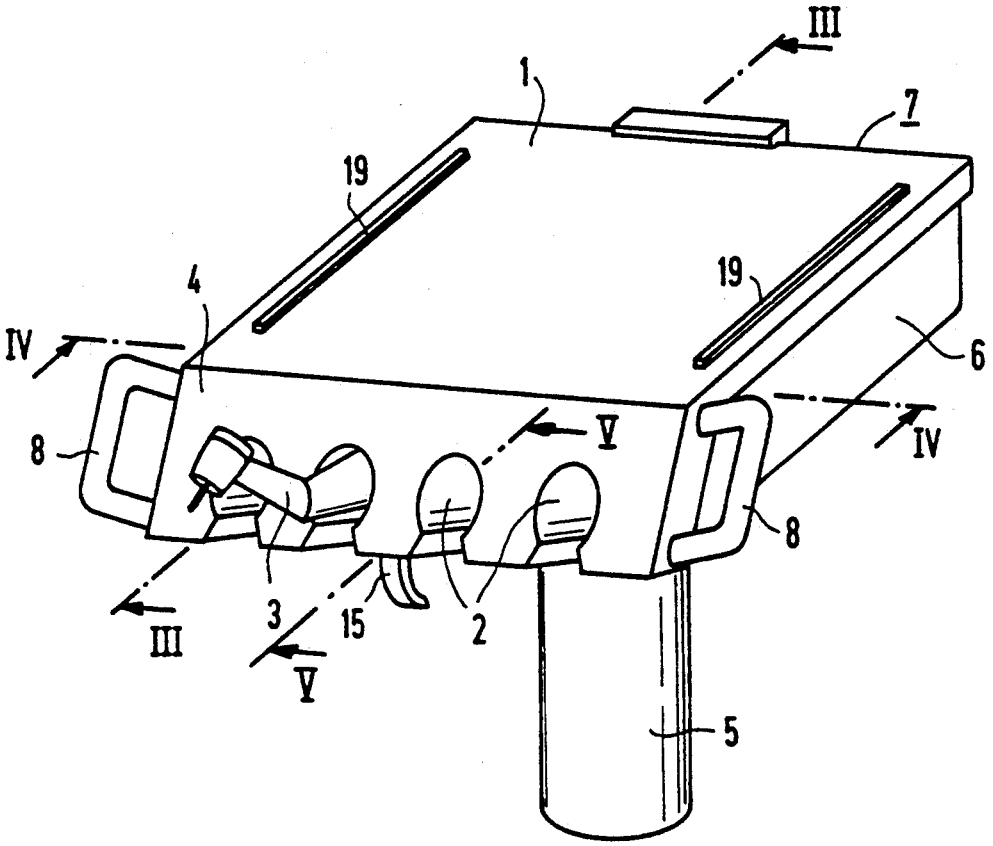
FIG. 1 is a perspective illustration of a dental instrument deposit table in accordance with the present invention.

The principles of the present invention are particularly useful when incorporated in a dental instrument deposit table, which is illustrated in FIG. 1 and includes a deposit surface 1 for the instruments, such as hand instruments, materials, etc., and contains a plurality of holder means 2 for receiving hose-bound and cable-bound handpieces 3. The holding means 2 are positioned on a surface 4 that extends obliquely forwardly inclined with respect to the planar deposit surface 1 and has the shape of a podium. The instrument deposit table contains a base member 6 (best illustrated in FIG. 2), which is mounted on a carrier 5, which forms mounting means for the member 6. A housing cover part or structural unit 7 is received on the base member 6 and the cover part 7 has the deposit surface 1, the oblique surface 4, together with the holding means 2 for the instruments, as well as grips 8 arranged on each side, which grips form the manipulation means. The carrier 5 can be fashioned in a known way as a floor or wall stand and can also be fashioned as a single-armed or multi-armed swivel arm.

Figure 2:
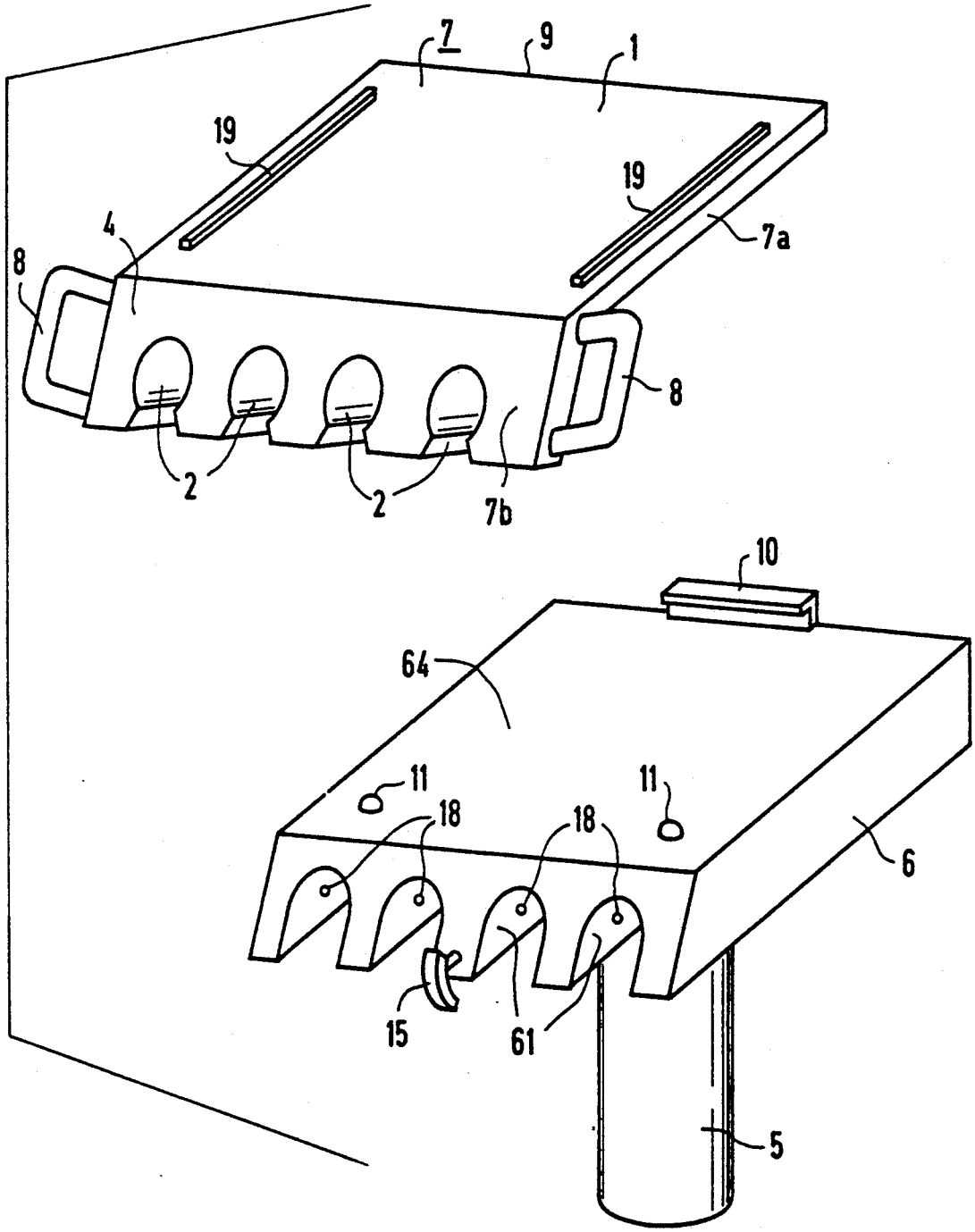
FIG. 2 is a perspective view of the dental instrument deposit table in accordance with the present invention illustrating the base member and the structural unit detached therefrom.
Figure 3:
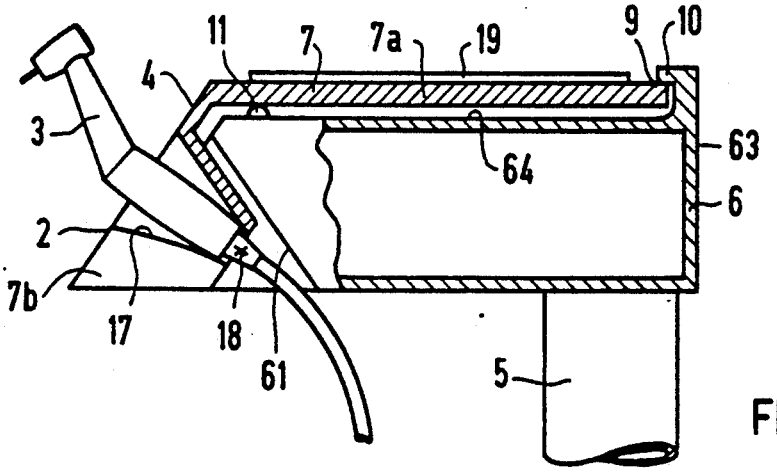
FIG. 3 is a cross sectional view taken along the lines III—III of FIG. 1 with portions in elevation.

FIG. 2 illustrates the base member 6, as well as the housing cover part or cover member 7, which are shown in separated or detached condition without the presence of the handpieces. The base member 6 accepts various controls and regulation parts for the handpieces in its interior in a known way and is, thus, fashioned as a hollow member which is closed at least on the sides and on the top. A ledge 10 is provided on a back side or wall 63 of the base member 6 and forms a catch nose to slightly project beyond a back edge part 9 of the housing cover part 7 when the housing cover part 7 is positioned on the base 6, as best illustrated in FIG. 3. Two spring elements 11 will press against the underside of a section 7*a* of the housing cover part 7, which contains a surface 1, and these spring elements are provided in a front region of the planar cover surface or top surface 64 of the base member 6, as shown in FIGS. 3 and 4.

Figure 5:
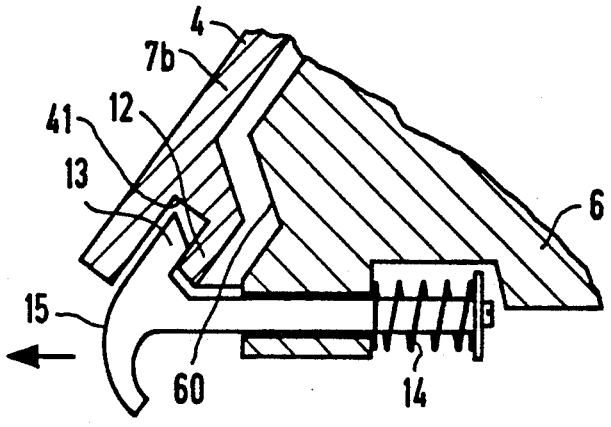
FIG. 5 is an enlarged partial cross sectional portion taken along the lines V—V of FIG. 1.

The cover part 7 has a section 7*b* which contains the oblique front surface 4, as illustrated in FIG. 5, which has a lower edge part 12 which has a groove or recess 41 to form a catch surface for a catch hook 13 that is loaded with a compression spring 14 and is displaceably held on the base member 6. The edge part 12, as illustrated in FIG. 5, is received in a recess 60 in the base 6 and the catch hook 13 is engaged in the recess 41 when the housing cover part 7 is put in place on the base member 6. The compression spring 14 insures that the housing cover part 7 is pressed against the base member 6 in a non-positive lock in this latched position. A handle 15 is provided for the catch 13 and serves the purpose of unlocking the catch 13 from the clamped position. The unlocking is, thus, possible with one hand in that the handle is pulled slightly forward in the direction of the arrow illustrated in FIG. 5. What is critical is that the handle need not be touched when putting the clean and disinfected or sterile housing cover part 7 back in place.

Figure 4:
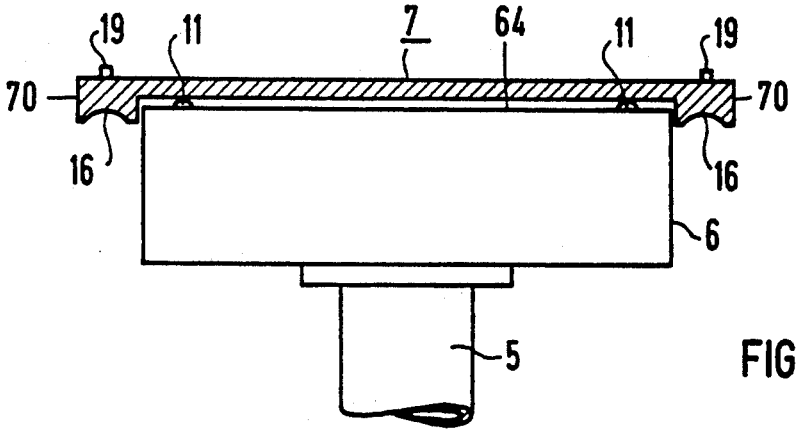
FIG. 4 is a cross sectional view with portions in elevation taken along the lines IV—IV of FIG. 1.

As may be seen in FIG. 4, the section 7*a* of the housing cover part 7 shown in cross section has a width greater than the width of the base member 6 and, thus, extends beyond the base member 6 on both sides. Thus, the section 7*a* has two overlapping parts 70 which provide a certain protection for the base member 6 against the precipitation of aerosol, which is usually likewise contaminated with germs. As may be seen from FIG. 2, this broadening of the housing cover part 7 is also present in the front section or region 7*b*.

The underside of the overlapping parts 70 of the section 7*a* of the housing cover part 7 is preferably provided with grasping depressions 16 on both sides, which will facilitate the removal of the housing cover part 7. Also, the overlapping parts 70 have shoulders 71 which prevent lateral movement of the part 7 on the member 6. Two elevations or rails 19 proceed along the table and are located in the upper surface. These rails or elevations 19 provide a lateral holding arrangement for receiving an instrument tray that may be potentially placed on the deposit surface 1.

In the illustrated exemplary embodiment, the holding means 2 for the handpieces are fashioned as deposit sockets which taper inward and have walls 17 at least so wide that they cannot be contaminated with germs due to the removal and redepositing of the instrument. The sockets are formed as an integral component part of the housing cover part 7 and the base portion 6 is provided with recesses 61 to provide clearance for these sockets. Sensors are provided for controlling the drives of the various handpieces and are in the form of, for example, light barriers which are expediently arranged not in the housing cover part 7, but in the recesses 61 of the base member 6. As illustrated in FIGS. 2 and 3, the appropriate locations of the sensor are referenced at the position 18. The housing cover part 7 is, thus, free from any electrical or electronic component parts.

Although it is conceivable to remove the parts 7*a*, 7*b* and 8 separately from the base member and to introduce them into the existing cleaning means, it is particular advantageous when these parts are formed as a one-piece component part. This component part is composed of a material that is at least resistant to standard cleaning and/or disinfecting agents and, potentially, sterilizing agents. An example of such a material is glass or a resin plastic material, such as a Melamin resin.

Although various minor modifications may be suggested by those versed in the art, it should be understood that we wish to embody within the scope of the patent granted hereon all such modifications as reasonably and properly come within the scope of our contribution to the art.

We claim:

1. A dental instrument deposit table comprising a base member having mounting means, a structural unit having a planar deposit surface for the instruments and containing holder means for receiving handpieces including handpieces connected to hoses and handpieces connected to cables extending from one edge of the deposit surface, said structural unit being a one-piece housing and being composed of a material at least resistant to cleaning agents and disinfectants, and clamping means for releasably mounting the structural unit on the base member to cover the base member in at least the regions of the deposit surface and holder means.

2. A dental instrument deposit table according to claim 1, wherein one of said base member and structural unit including manipulation means for changing the position of the instrument deposit table, said manipulation means also being removably mounted and composed of said material.

3. A dental instrument deposit table according to claim 1, wherein the housing cover part is constructed with a podium-like shape having an oblique front surface containing the holder means, said oblique front surface merging into a horizontal planar deposit surface of the part.

4. A dental instrument deposit table according to claim 1, wherein the holding means include tapering walls forming sockets which are integral component parts of the housing cover part.

5. A dental instrument deposit table according to claim, wherein the section of the structural member forming at least the deposit surface has a width greater than the base member so that it extends beyond the base member.

6. A dental deposit instrument table according to claim 5, wherein the deposit surface has overlapping parts extending on both sides of the base member.

7. A dental instrument deposit table according to claim 6, wherein the underside of each of the overlapping parts of the section forming the deposit surface is provided with a grasping depression.

8. A dental instrument deposit table comprising a base member having mounting means, a structural unit having a deposit surface for the instruments and containing holder means for receiving handpieces including handpieces connected to hoses and handpieces connected to cables, clamping means for removably mounting the structural unit on the base member, said clamping means being unlockable with the assistance of a handle, and the structural unit being composed of a material at least resistant to cleaning agents and disinfectants.

9. A dental instrument deposit table according to claim 8, wherein the clamping means automatically clamps the structural unit on the base member when the structural unit is placed on the base member.

10. A dental instrument deposit table according to claim 9, wherein the clamping means comprises a catch nose provided on the base member for engaging an edge of the section forming the deposit surface of the structural unit and includes a catch hook engaging behind an edge part of another section of the structural unit extending at an oblique angle to the first-mentioned section, wherein the catch hook is adjustably held on the base member by a biasing means, which is unlockable with an integral handle.

11. A dental instrument deposit table according to claim 10, wherein the catch hook includes an integral handle.

12. A dental instrument deposit table comprising a base member having mounting means, a one-piece structural unit having holder means in front of said table receiving handpieces including handpieces connected to hoses and handpieces connected to cables, said one-piece structural unit having manipulation means for changing the position of the instrument deposit table, clamping means for removably mounting the structural unit on the base member and said structural unit being composed of a material at least resistant to cleaning agents and disinfectants.

* * * * *